US005237849A

United States Patent [19]

Miyazawa

[11] Patent Number: 5,237,849

[45] Date of Patent: Aug. 24, 1993

[54] METHOD OF MANUFACTURING FINS FOR HEAT EXCHANGERS

[75] Inventor: Toshiki Miyazawa, Tokyo, Japan

[73] Assignee: Hidaka Seiki Kabushiki Kaisha, Tokyo, Japan

[21] Appl. No.: 836,863

[22] Filed: Feb. 19, 1992

[51] Int. Cl.[5] ..... B21D 53/04

[52] U.S. Cl. ..... 72/335; 72/333; 72/379.2; 29/890.047

[58] Field of Search ..... 72/333, 327, 379.2, 72/377, 335; 29/890.047, 890.043

[56] References Cited

U.S. PATENT DOCUMENTS

| | | | |
|---|---|---|---|
| 3,377,700 | 4/1968 | Cooley | 72/333 |
| 3,575,122 | 4/1971 | Brossart | 72/333 |
| 4,055,067 | 10/1977 | Kozima | 72/328 |
| 5,075,951 | 12/1991 | Schurr | 72/335 |

FOREIGN PATENT DOCUMENTS

| | | | |
|---|---|---|---|
| 642053 | 1/1979 | U.S.S.R. | 72/379.2 |
| 1034814 | 8/1983 | U.S.S.R. | 72/327 |

*Primary Examiner*—Daniel C. Crane

[57] ABSTRACT

The present invention provides a method of manufacturing fins for heat exchangers, wherein a collared through-hole of a prescribed height can be easily formed while using volatile oils as machining oil, even if the material of the metal plate is thinner and harder than conventionally used. To achieve the object, the method has following steps: forming a conical section in a metal plate, wherein the base diameter of the conical section is greater than the diameter of the collared through-hole to be formed, and the thickness of the top section of the conical section is thinner than other parts of the metal plate; transforming the conical section into a truncated conical section or a columnar section by extending and flattening the top section of the conical section; forming a through-hole and a projected section about the edge of the through-hole, by boring and burring the truncated conical section or columnar section; and ironing the projected section with a punch, whose outer diameter is equal to the inner diameter of the collared through-hole to be formed, and a die, whose inner diameter is equal to the outer diameter of the collared through-hole to be formed.

6 Claims, 7 Drawing Sheets

METHOD OF MANUFACTURING FINS FOR HEAT EXCHANGERS

BACKGROUND OF THE INVENTION

The present invention relates to a method of manufacturing fins for heat exchangers; more precisely relates to a method of manufacturing fins for heat exchangers such as air conditioners.

Radiating fins for heat exchangers of air conditioners are made of rectangular metal plates, e.g. aluminum plate, with a plurality of collared through-holes with a prescribed collar height.

A heat exchanger's radiating section composed of said fins is assembled by, first, stacking a plurality of fins such that the collared through-holes are coaxial. Then, pipes made of heat conductive material, e.g. copper, are inserted through the through-holes to integrate the fins.

The conventional method of manufacturing fins for heat exchangers will be explained with reference to FIG. 7B.

The method shown in FIG. 7B comprises following steps:

forming a shallow inverted vessel section 106, which looks like a truncated cone or a column, in a metal plate, wherein the bottom diameter of the inverted vessel section 106 is greater than that of a collared through-hole to be formed [step shown in (i)];

drawing the inverted vessel section 106 so as to gradually reduce the diameter thereof while increasing the height until a first prescribed height is obtained [steps shown in (ii), (iii) and (iv)];

boring and burring the inverted vessel section 109 until a second prescribed height is obtained, thus forming a collar 104 [step shown in (v)]; and forming a flange section 105 by outwardly bending the front end section of the collar 104 [step shown in (vi)].

In the method (drawing method) shown in FIG. 7B, high collars can be formed, but coaxial circular punch marks or wrinkles are apt to form near the collared through-holes, and the metal plate is apt to be twisted or otherwise warped during the drawing steps for reducing the diameter of the inverted vessel section.

Furthermore, as shown in FIG. 8, the corners of the inverted vessel section become relatively thinner during the drawing steps, so that the metal plate hardens and is apt to crack, resulting in greater difficulties in machining.

To solve the above described disadvantages, there is disclosed a manufacturing method in the U.S. Pat. No. 4,055,067 (see FIG. 7A). The method shown in FIG. 7A is described below:

The first step is boring and burring a metal plate 100 to form a through-hole 101, which is described by a projected section 102 [step shown in (a)].

Next, the projected section 102 is ironed to expand the diameter of the through-hole 101 so as to form a collar having a prescribed height [steps shown in (b) and (c)]. This ironing of the projected section 102 and the collar 103 is executed by an outer circumferential face of a punch and an inner face of a die.

In the method shown in FIG. 7A, the ironing has two steps, and the diameters of punches and dies are different in each step.

The front end of the collar 104, which has the prescribed height, is then bent to form a flange 105 [step shown in (d)].

In the method (ironing method) shown in FIG. 7A, the diameter of the through-hole is expanded during the ironing steps, so that no coaxial punch marks are formed near the collared through-holes. Furthermore, even if the metal plate is made of a hard metal, which is typically difficult to machine by ironing, collared through-holes having a prescribed height can be formed.

In the above described ironing method, however, the use of thinner metal plates decreases the degree of effective ironing potential due to formation of unacceptably thin collar walls, and it is therefore difficult to form high collared through-holes.

To solve the aforementioned problem, it is necessary to bore small through-holes and then form relatively high projected sections in said thin metal plates prior to ironing. The degree of reduction of the diameter of the through-hole is limited, however, because in plates having holes too small, cracks are apt to form in the collars during ironing.

Currently, thinner fins are required for economical operation and weight reduction of air conditioners, and it is difficult to machine these thinner metal plates using the convention ironing method.

On the other hand, in the drawing method, there is no limitation caused by the thickness of the metal plates, but machining is more difficult because the metal plates have a greater hardness in order to have sufficient mechanical strength.

Furthermore, for environmental protection, the usage of Freon ("Freon" is the trademark for fluorocarbons) has been restricted, and it's utilization in the removal of machining oil from the machined fins may be prohibited in the near future.

The use of volatile oils as machining oils has been proposed to eliminate the need for Freon cleaning, but the ironing degree decreases with use of volatile oils. Because of the lower ironing degree, and thinner yet harder metal plates, it is quite difficult to form the collared through-holes to the prescribed height.

SUMMARY OF THE INVENTION

An object of the present invention is to provide a method of manufacturing air conditioner fins which is capable of easily forming in thinner and harder metal plates, collared through-holes having a prescribed height.

Another object is to provide a method of manufacturing fins for air conditioners which is capable of using volatile oils as machining oils while forming in the metal plates the collared through-holes to the prescribed height.

To achieve the objects, the inventor's research led to the method of the present invention, which is capable of forming sufficiently high collared through-holes on thinner and harder metal plates, while using volatile oils as machining oils.

The method of the present invention of manufacturing fins having a collared through-hole for heat exchangers comprises the steps of: forming a conical section in a metal plate, wherein the base diameter of the conical section is greater than the diameter of the collared through-hole to be formed, and the thickness of the top section of the conical section is thinner than other parts of the metal plate; transforming the conical section into a truncated conical section or a columnar section by extending and flattening the top portion of the conical section; forming a through-hole with a projected section about the edge of the through-hole, by boring and burring the truncated conical section or columnar section; and ironing the projected section with a punch whose outer diameter is the same as the inner diameter of the collared through-hole to be formed, and a die whose inner diameter is the same as the outer diameter of the collared through-hole to be formed.

In the present invention, the conical section may be formed by a cylindrical die and a columnar punch, which presses the point of the metal plate corresponding to the center of the circular cylindrical die. Thus, the conical section can be formed easily and economically.

Furthermore, the truncated conical section or columnar section may be easily formed by a punch whose front end is flat.

In the conventional drawing method, when the inverted vessel section with a flat upper face is formed, the corners undergo thickness reduction at a higher rate than other sections of the vessel section, and resultingly, stress concentrates to said corners. The stress hardening further results in some fracturing of the metal plates during the drawing process.

On the other hand, in the present invention, the conical section with a thinner top section is formed beforehand so that the stress concentrates to said thinner top section when the conical section is transformed into the truncated conical section or the columnar section. By redirecting the stress concentration to the thinner top section, which is subsequently removed by boring and burring, thicker side walls—subsequently formed into a projected section not prone to stress fractures—can be formed.

Therefore, the projected section about the edge of the through-hole can be significantly higher, while maintaining a thicker projected section.

As the result, even if thinner and harder metal plates are used, collared through-holes having a prescribed height can be formed easily using the ironing method to achieve said prescribed height and using volatile oils as machining oils.

BRIEF DESCRIPTION OF THE DRAWINGS

The present invention will be apparent from the following description, reference being had to the accompanying drawings wherein preferred embodiment of the present invention are clearly shown.

In the drawings.

DETAILED DESCRIPTION OF THE PREFERRED EMBODIMENT

The preferred embodiment of the present invention will now be described in detail with reference to accompanying drawings.

Figure 1:
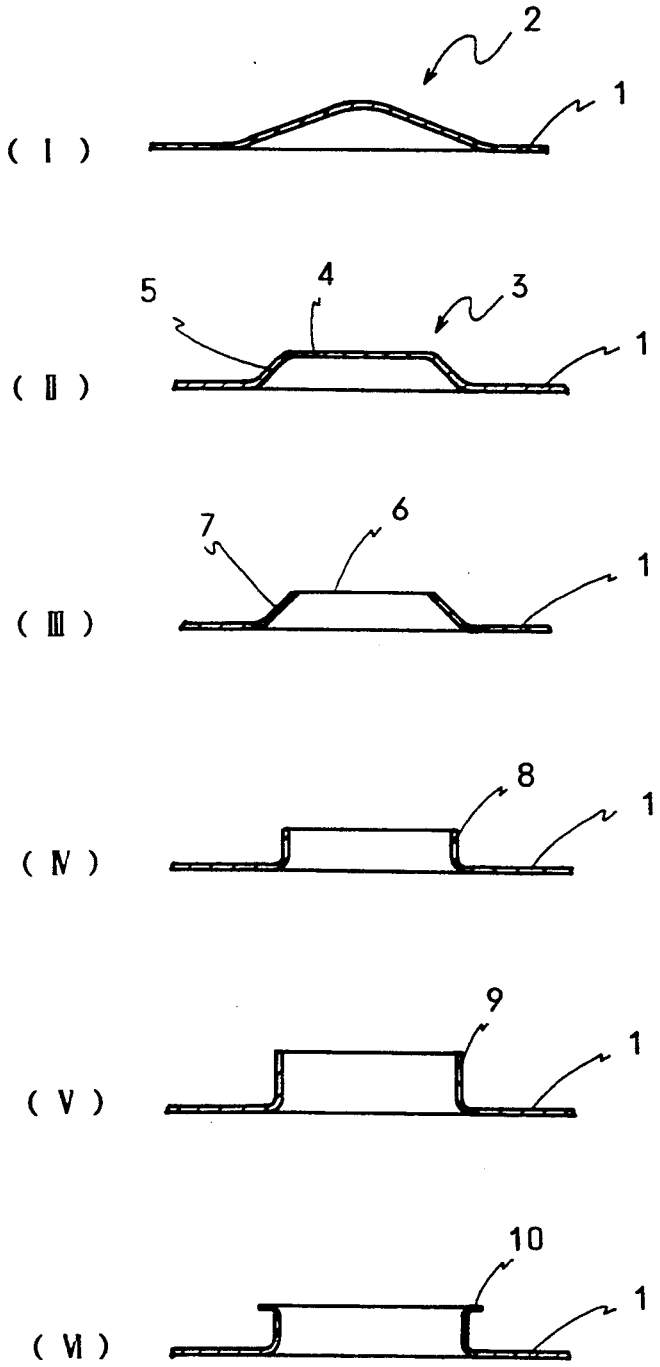
FIG. 1 is explanatory views showing manufacturing steps (I) through (VI) of the present invention.

FIG. 1 shows the steps of the method of the present embodiment.

Figure 2A:
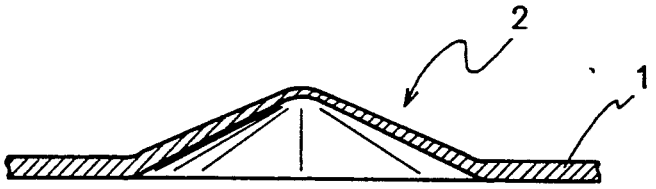
FIG. 2A is a sectional view of the conical section and FIGS. 2B is a sectional view of the truncated conical section formed in the steps shown in FIG. 1 (I) and (II) respectively.

The method includes the steps of:

Forming a conical section 2 in a metal plate 1 on which a volatile oil is applied as a machining oil [step shown in FIG. 1 (I)]. The base diameter of the cone section 2 is greater than the inner diameter of a collared through-hole to be formed, and the top section of the conical section 2 is thinner than other parts of the metal plate 1 (see FIG. 2A).

Figure 2B:
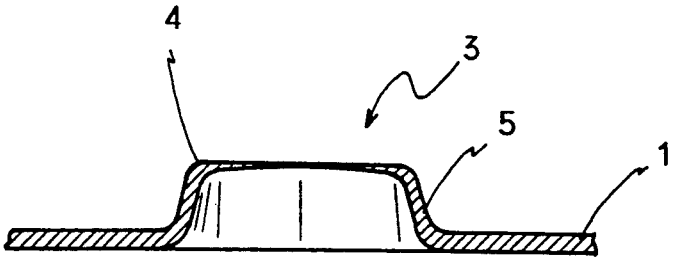

Transforming the conical section 2 into a inverted vessel section 3, which looks like a truncated cone or a column, by extending the thinner top section of the conical section 2 [step shown in FIG. 1 (II)]. By so extending the conical section 2, a flat section 4 is formed. The center of the flat section 4 is thinner than, and wall section 5 is almost the same thickness as, the main part of the metal plate 1 (see FIG. 2 B).

Boring and burring the flat section 4 of the inverted vessel section 3 so as to form a projected section 7 about the edge of the through-hole 6 [step shown in FIG. 1 (III)].

Forming the collared through-hole to a prescribed height by ironing the projected section 7 and a collar 8 [steps shown in FIG. 1 (IV) and (V)].

And, if necessary, forming a flange section 10 by outwardly bending a front end of a collar 9, [step shown in FIG. 1 (VI)].

In comparing the method of the present embodiment to the conventional ironing method, the height of the collar of the present embodiment can be about 20% higher than that formed by the conventional method. In both methods, a volatile oil is applied to the metal plate.

As described above, the method of the present embodiment is capable of easily forming collared through-holes having the prescribed height even if the metal plate is thin and hard, and even if volatile oil is applied as machining oil.

Next, an apparatus for the method will be explained. The method shown in FIG. 1 (I) can be executed by a die set as shown in FIG. 3A.

Figure 3A:
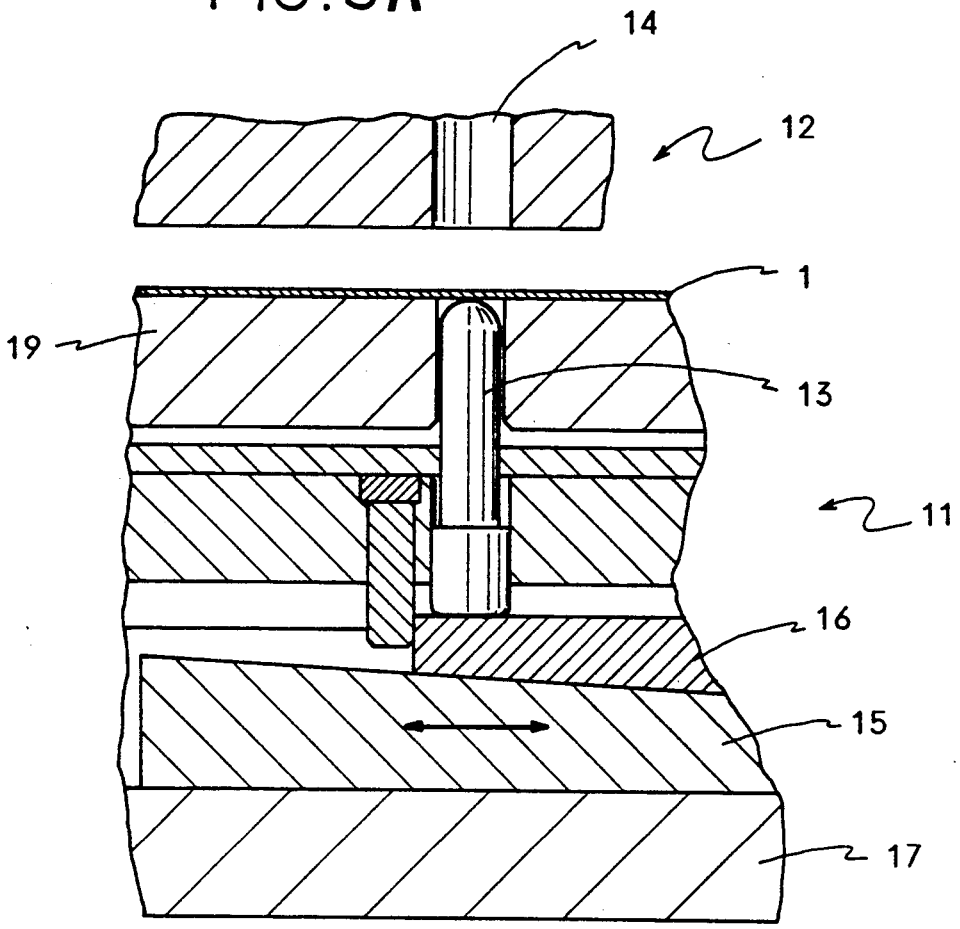
FIGS. 3A and 3B are sectional views of a die set for applying the step shown in FIG. 1 (I)

The die set shown in FIG. 3A has a lower set 11 and an upper set 12. On the lower set 11, there is provided a punch 13 whose front end is hemisperical. The punch 13 is perpendicularly provided with respect to the metal plate 1, which is set on a biased table 19.

The punch 13 is fixed to an up-down plate 16, whose bottom face is capable of sliding on a slide plate 15, the upper face of which is an inclining plane. The height of the punch 13 can be adjusted by moving the slide plate 15 on a base plate 17 in the directions shown by an arrow.

Note that the biased table 19 is biased upward by a biasing means (not shown).

In the present embodiment, the metal plate 1 is pressed downward by the upper set 12, then the biased table 19 descends while the front end of the punch 13 projects from the upper face of the biased table 19.

Figure 3B:
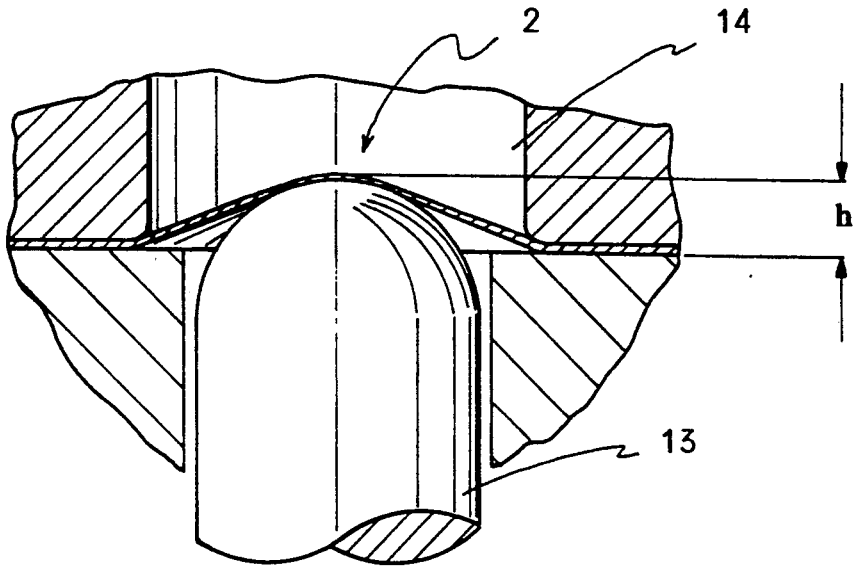

Because of the upwards projection of the punch 13, the concal section 2 of the metal plate 1 is formed between the die 14 of the upper set 12 and the punch 13 (see FIG. 3B).

The base diameter of the conical section 2 is greater than the diameter of the collared through-hole to be formed.

The conical section 2 of the metal plate 1 is formed by the hemispherical front end of punch 13, so that the top section of the conical section 2 is thinner than other parts of the metal plate 1.

Note that determination of the height h of the conical section 2 is based on selection of the material of the metal plate 1 and also on the diameter of the collared through-hole to be formed.

Figure 4A:
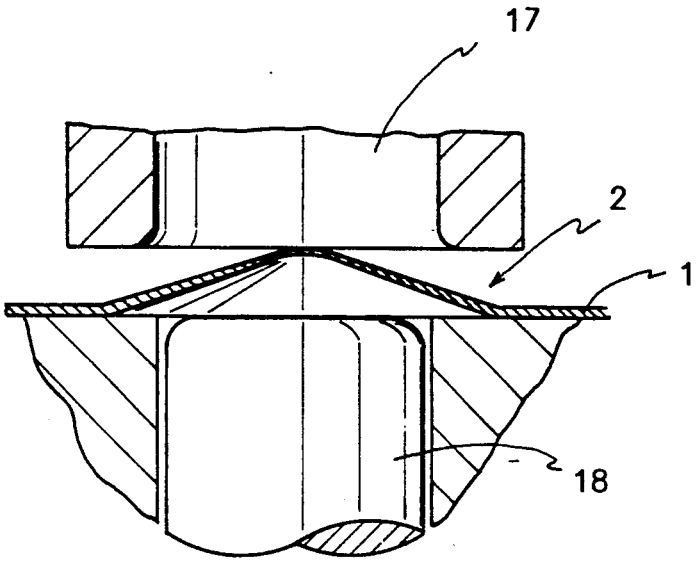
FIGS. 4A and 4B are sectional views of a die set for applying the step shown in FIG. 1 (II)
Figure 4B:
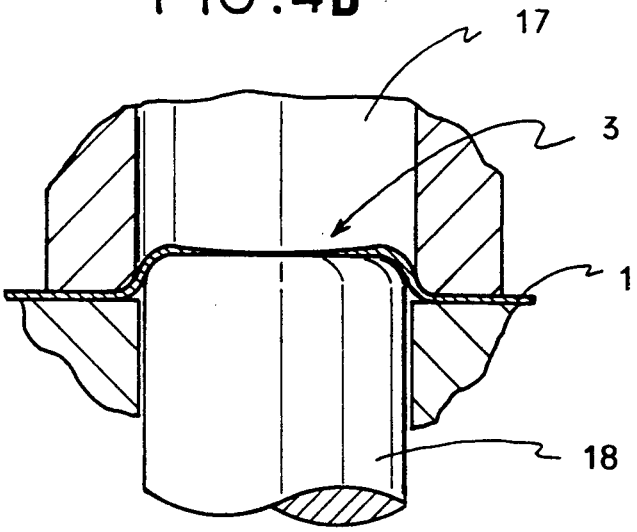

The step of transforming the conical section 2 into the inverted vessel section 3 (see FIG. 1 (II)), which looks like a truncated cone or a column, can be executed by a die set as shown in FIG. 4A and FIG. 4B.

The die set shown in FIG. 4A and FIG. 4B has a lower set having a punch 18, whose front end is flat, and a upper set having a die 17. The base of the conical section 2 of the metal plate 1 can be held between the lower set and the upper set (see FIG. 4B).

In FIG. 4A and FIG. 4B, the base section of the conical section 2 of the metal plate 1 is so held, and the inner face of the conical section 2 is pressed by the punch 18 so as to flatten the top section, thus forming the inverted vessel section 3.

During the formation of the inverted vessel section 3, the required through-hole may be bored in the center thereof.

Figure 5:
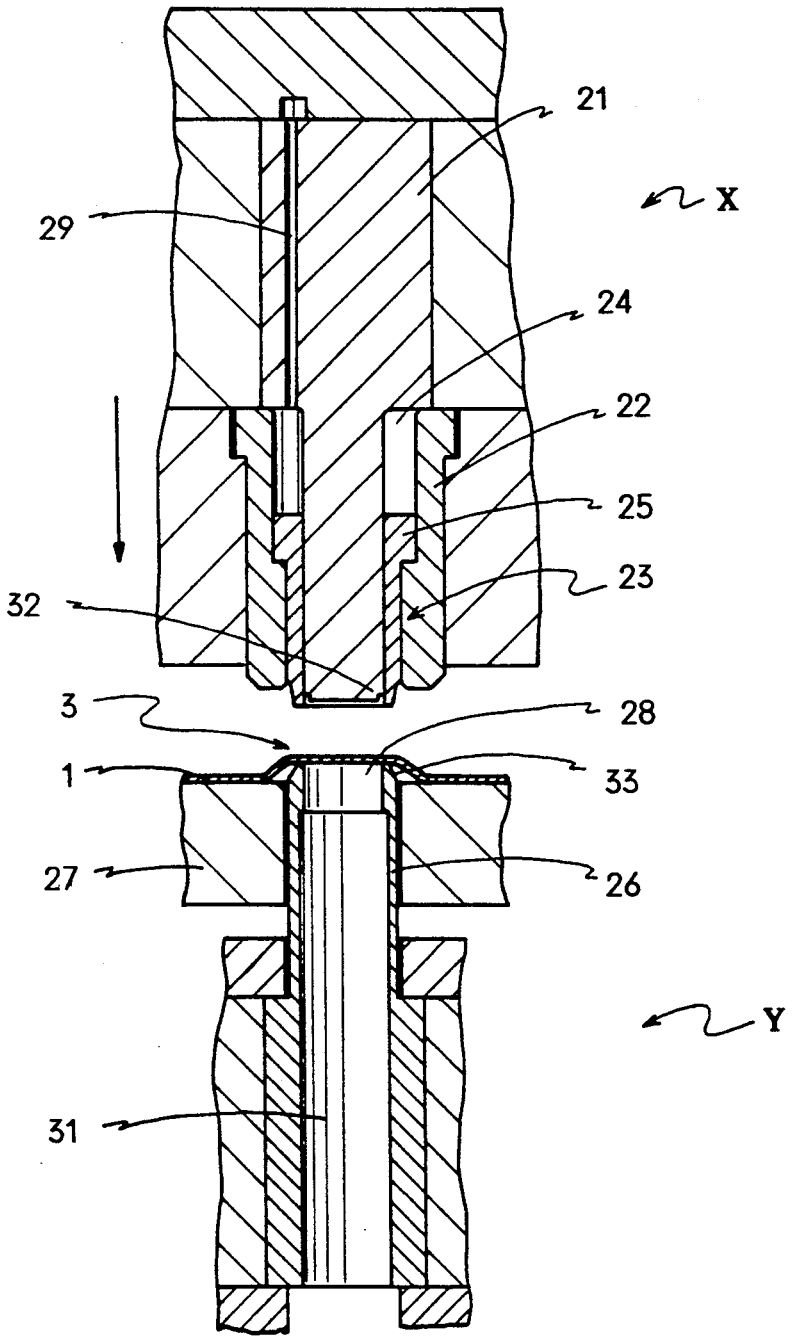
FIG. 5 is a sectional view of a die set for applying the steps shown in FIG. 1 (III)-(V)

The boring, burring (see FIG. 1 (III)) and ironing (see FIG. 1 (IV) and (V)) of the top flat section of the inverted vessel section 3 may be executed by a die set having exclusive punches and dies, but it is preferable to use a die set as shown in FIG. 5.

In the die set shown in FIG. 5, a cylindrical ironing bushing 22 is vertically fixed to an upper base X, which is part of an upper set. There is formed a hollow stepped section in the ironing bushing 22. The inner diameter of the front section of the hollow stepped section is less than that of the rear section thereof. The inner diameter of the front section is equal to the outer diameter of the collared through-hole to be formed.

A cylindrical knock-out bushing 23, which has a flange 25 at the top end, is fitted to the front section of the hollow stepped section of the ironing bushing 22. The knock-out bushing 23 is vertically slidable.

The flange 25 can slide on the inner face of the rear section of the hollow stepped section of the ironing bushing 22.

The knock-out bushing 23 slidably contains a columnar pierce punch 21, which is vertically fixed to the upper base X.

The outer diameter of the main part of the pierce punch 21, including cutting teeth 32, is less than the inner diameter of the collared through-hole to be formed. Furthermore, the outer diameter of the cutting teeth 32 is less than that of the main part. The difference is about 5-10% of the thickness of the metal plate 1 to prevent flash along the edges of the through-hole.

The space described by the upper face of the flange 25 of the knock-out bushing 23, the inner face of the ironing bushing 22 and the outer face of the pierce punch 21 is an air chamber 24 to which compressed air is introduced via an air path 29 so as to maintain a positive pressure. The compressed air in the air chamber 24 always biases the knock-out bushing 23 downward so that, at the bottom dead point, the front end of the knock-out bush 23 is lower than that of the ironing bushing 22.

The upper base X of the upper set is vertically moved by a press mechanism (not shown).

On the other hand, a cylindrical ironing punch 26 is vertically fixed to a lower base Y of the lower set. The ironing punch has an upper hollow section 28 and a lower hollow section 31. The inner diameter of the upper hollow section 28 is less than that of the lower hollow section 31. When the upper base X descends, the pierce punch 21 slides on the inner face of the hollow section 28.

There is formed a tapered face 33 on the circumferential face of the front end section of the ironing punch 26.

The ironing punch 27 is loosely inserted through a biased table 27, which is biased upward by biasing means (not shown). The tapered front end of the ironing punch 26 projects from the biased table 27.

Next, the action of forming the collared through-hole using the above described die sets will be explained with reference to FIG. 5 and FIG. 6A-D.

First, the flat section of the inverted vessel section 3, which is shaped as a truncated cone, is set on the biased table 27 such that it is coaxial and perpendicular to the ironing punch 26, and the upper base X is then moved downward by force of the press mechanism.

At that time, the knock-out bushing 23 is biased downward by the compressed air in the air chamber 24, introduced via the air path 29, and the flange 25 of the knock-out bushing 23 is located at the lowest position. In this state, the front end face of the knock-out bushing 23 contacts the flat section of the inverted vessel section 3, which is supported by the front end of the ironing punch 26, so that the metal plate 1 is secured in position by the positive air pressure in the air chamber 24 [step shown in FIG. 6A].

The knock-out bushing 23, in contact with the front end face of the ironing punch 26 via the metal plate 1, does not descend with the upper base X, but is stopped at a prescribed position.

On the other hand, the flange 25 of the knock-out bushing 23 is capable of moving upwards against the biasing force of the compressed air in the air chamber 24, to a relatively higher position in the air chamber 24 when the upper base X further descends. Therefore, the upper base X is capable of driving the pierce punch 21 further downward. Because of this movement, the pierce punch 21 punches a through-hole, using the ironing punch 26 as a die.

The front end face of the ironing bushing 22 presses the metal plate 1 against the upper face of biased table 27. The through-hole is then burred by the tapered section 33 of the ironing punch 26. At that time, the front end face of the knock-out bushing 23 directly contacts that of the ironing punch 26 [step shown in FIG. 6B].

Successively, the upper base X descends and presses the metal plate 1 and the biased table 27 downward. The projected section, formed by burring, is ironed by the inner face of the ironing bushing 22 and the outer circumferential face of the front end section of the ironing punch 26 so as to form a collar. During this step, the pierce punch 21 descends together with the upper base X; the outer circumferential face of the front end section of the pierce punch 21 slides downward on the inner face of the front end section of the ironing punch 26 [step shown in FIG. 6C].

This enables the front end of the pierce punch 21 to support the ironing punch 26 from the inside so as to prevent a diameter reduction thereof, which would otherwise be caused by the force applied thereto during the ironing step.

When the collar reaches the prescribed height, the downward movement of the upper base X is stopped, and the upper base X begins to ascend. The pierce punch 21 and the ironing bushing 22 ascend together with the upper base X.

Figure 6A:
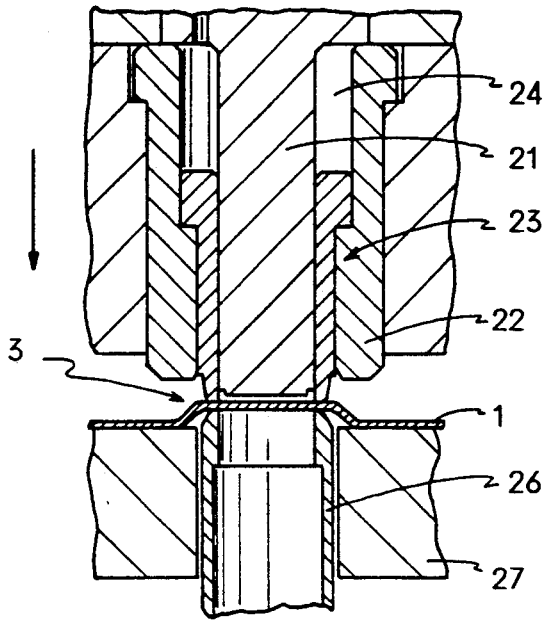
FIGS. 6A, 6B, 6C and 6D are explanatory views showing the action of the die set shown in FIG. 5.
Figure 6B:
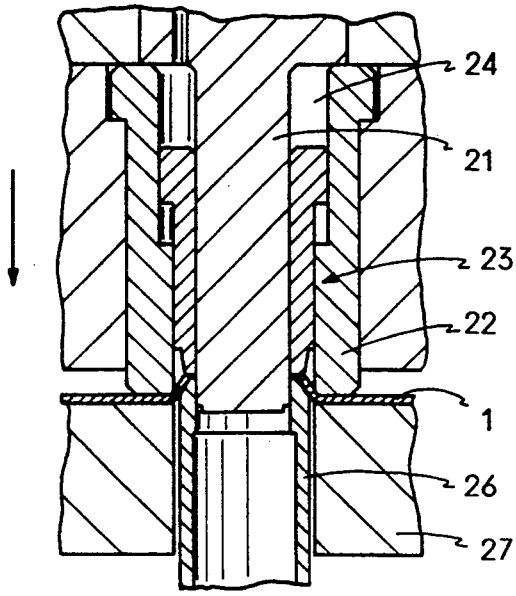
Figure 6C:
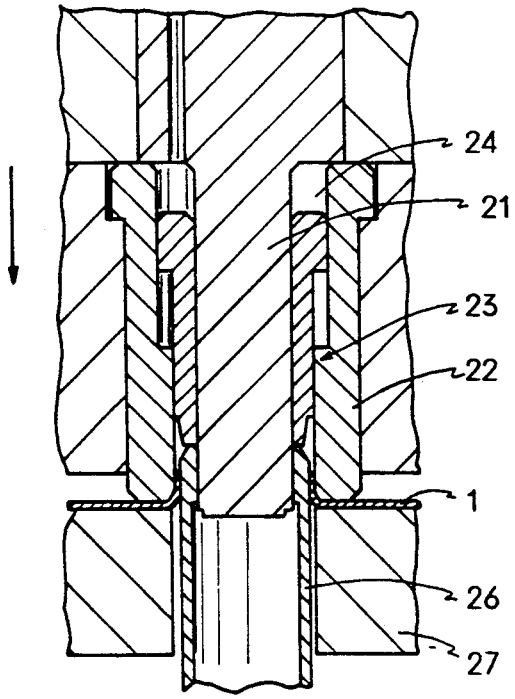
Figure 6D:
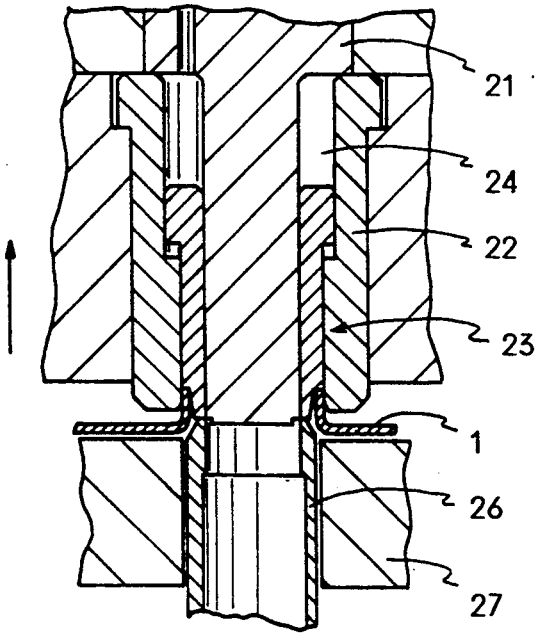
Figure 7A:
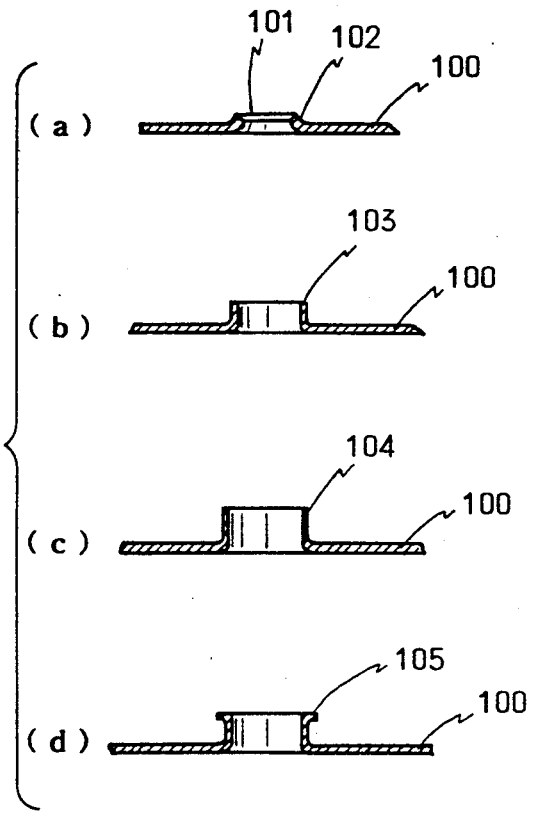
FIG. 7A PRIOR ART
FIG. 7A is explanatory views showing known method steps (a)-(d) of manufacturing fins.
Figure 7B:
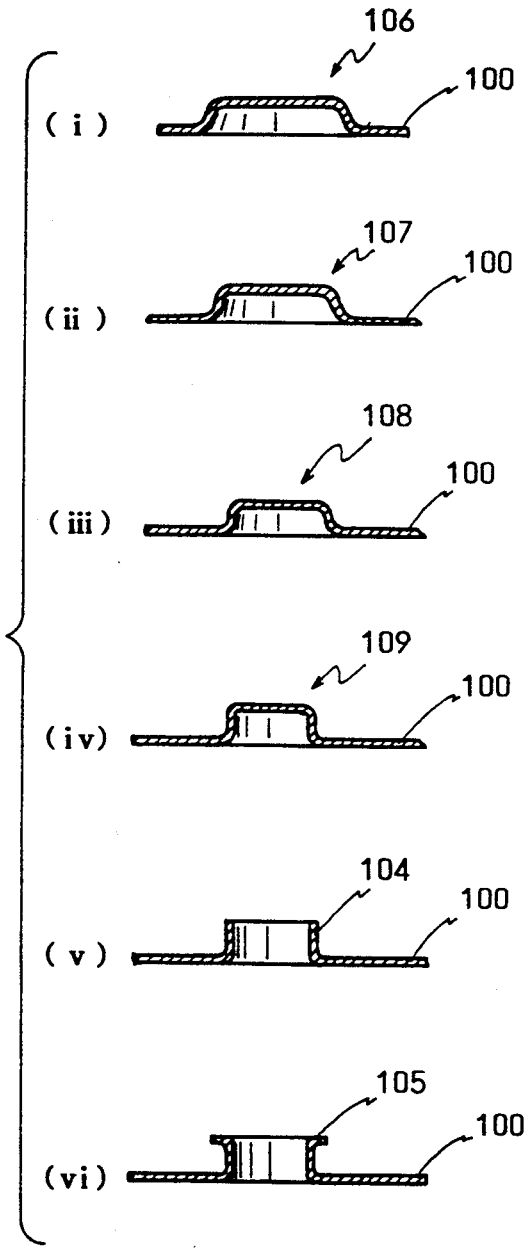
FIG. 7B PRIOR ART
FIG. 7B is explanatory views showing conventional method of steps (i)-(vi) of manufacturing fins.
Figure 8:
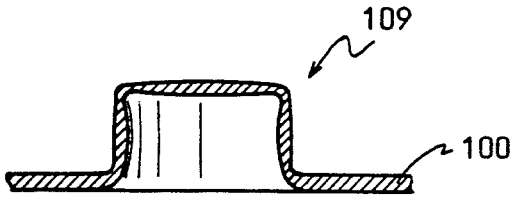
FIG. 8 is sectional views of the inverted vessel section, which is formed in the steps shown in FIG. 7B (iv).

Concurrently, the knock-out bushing 23 maintains contact with the front end face of the ironing punch 26 until the flange 25 regains the lowest position in the air chamber 24, thereby separating the metal plate 1 from the lower end face of the ironing bushing 22 [step shown in FIG. 6D].

After the upper base X ascends and the flange 25 has reached the lowest position in the air chamber 24, the knock-out bushing 23 ascends with the upper base X.

To increase the height of the collared through-hole, further ironing may be performed on the collar until the prescribed height is attained. Then, the front end of the collar may be bent to form the flange 10, if necessary [step shown in FIG. 1 (VI)].

In the die sets shown in FIG. 5–FIG. 6D, the knock-out bushing 23 is biased by compressed air, but it may be biased by another biasing means such as spring.

An air path may be formed in the pierce punch 21. In this case, compressed air can be sprayed through said air path to cool the mechanisms and to remove metal dust.

In the present invention, even if the metal plate is thin and hard, collared through-holes having a prescribed height can be easily formed despite the difficulties of machining by the conventional ironing and drawing methods.

Furthermore, even if volatile oils are used as machining oils, the collared through-holes having a prescribed height can be formed, and chips can be removed by solvents such as alcohol instead of Freon.

The invention may be embodied in other specific forms without departing from the spirit or essential characteristics thereof. The present embodiment is therefore to be considered in all respects as illustrative and not restrictive, the scope of the invention being indicated by the appended claims rather than by foregoing description and all changes which come within the meaning and range of equivalency of the claims are therefore to be embraced therein.

What is claimed is:

1. A method of manufacturing fins having collared through-holes for heat exchanger comprising the steps of:

forming a conical section in a metal plate, the base diameter of said conical section being greater than the diameter of said collared through-hole to be formed, the thickness of a top section at the apex of said conical section being thinner than other parts of said metal plate;

transforming said conical section into a truncated conical section by extending and flattening the top section of said conical section so that the center of the flat top section is thinner than other parts of the metal plate;

boring the flattened top section to form a through-hole;

burring the top section to form a projected section about an edge of the through-hole; and ironing said projected section with a punch, whose outer diameter is the same as the inner diameter of said collared through-hole to be formed, and a die, whose inner diameter is the same as the outer diameter of said collared through-hole to be formed, to form said collared through-hole in said metal plate.

2. The method of manufacturing fins for heat exchangers according to claim 1, wherein said conical section is formed by a cylindrical die and a columnar punch having a hemispherical end which presses a point of said metal plate corresponding to the center of said circular cylindrical die.

3. The method of manufacturing fins for heat exchangers according to claim 1, wherein said truncated cone section is formed by a punch having a flat end.

4. A method of manufacturing fins having collared through-holes for heat exchanger comprising the steps of:

forming a conical section in a metal plate, the base diameter of said conical section being greater than the diameter of said collared through-hole to be formed, the thickness of a top section at the apex of said conical section being thinner than other parts of said metal plate;

transforming said conical section into a columnar section by extending and flattening the top section of said conical section so that the center of the flat top section is thinner than other parts of the metal plate;

boring the flattened top section to form a through-hole;

burring the top section to form a projected section about an edge of the through-hole; and ironing said projected section with a punch, whose outer diameter is the same as the inner diameter of said collared through-hole to be formed, and a die, whose inner diameter is the same as the outer diameter of said collared through-hole to be formed, to form said collared through-hole in said metal plate.

5. The method of manufacturing fins for heat exchangers according to claim 4, wherein said conical section is formed by a cylindrical die and a columnar punch having a hemispherical end which presses a point of said metal plate corresponding to the center of said circular cylindrical die.

6. The method of manufacturing fins for heat exchangers according to claim 4, wherein said columnar section is formed by a punch having a flat end.

* * * * *